US007993025B2

(12) United States Patent
Chiu

(10) Patent No.: US 7,993,025 B2
(45) Date of Patent: Aug. 9, 2011

(54) LED LAMP

(75) Inventor: Hua-Jung Chiu, Jhongli (TW)

(73) Assignee: Davinci Industrial Inc., Taipei Hsien (TW)

( * ) Notice: Subject to any disclaimer, the term of this patent is extended or adjusted under 35 U.S.C. 154(b) by 0 days.

(21) Appl. No.: 12/591,757

(22) Filed: Dec. 1, 2009

(65) Prior Publication Data

US 2011/0128730 A1 Jun. 2, 2011

(51) Int. Cl.
*F21V 21/00* (2006.01)

(52) U.S. Cl. ..... 362/249.02; 362/294; 362/249.11

(58) Field of Classification Search ..... 362/147, 362/148, 249.01, 249.02, 227, 240, 249.1, 362/249.11, 294, 363, 373, 800
See application file for complete search history.

(56) References Cited

U.S. PATENT DOCUMENTS

| | | | | |
|---|---|---|---|---|
| 7,832,909 | B2 * | 11/2010 | Wang | 362/364 |
| 2009/0141500 | A1 * | 6/2009 | Peng | 362/294 |
| 2009/0213595 | A1 * | 8/2009 | Alexander et al. | 362/373 |
| 2009/0237940 | A1 * | 9/2009 | Wu et al. | 362/280 |
| 2010/0096992 | A1 * | 4/2010 | Yamamoto et al. | 315/112 |
| 2010/0103675 | A1 * | 4/2010 | Yu et al. | 362/253 |

* cited by examiner

*Primary Examiner* — Hargobind S Sawhney
(74) *Attorney, Agent, or Firm* — Rosenberg, Klein & Lee

(57) ABSTRACT

An LED lamp includes a heat dissipating body, a rotating front cover, an LED assembly, a lens assembly, a driving unit, and a socket. The heat dissipating body has a plurality of fins for dissipating heat. The rotating front cover is rotatably disposed in the front side of the heat dissipating body, the inner wall of the rotating front ring has a screwed channel. The LED assembly is disposed in the heat dissipating body. The lens assembly has a screwed thread mating to the screwed channel and disposed in the heat dissipating body. The lens assembly can be moved via rotating the rotating front cover. As a result, the illuminating angle of the LED lamp is adjustable.

8 Claims, 5 Drawing Sheets

LED LAMP

BACKGROUND OF THE INVENTION

1. Field of the Invention

The present invention relates to a LED lamp, and in particular to an improved LED lamp with adjustable illuminating angle.

2. Description of Related Art

Light emitting diode (LED) are used in many applications such as lamps, flat screen displays and devices to provide illumination. LED are small, inexpensive, lower power, long used life, etc., so more and more LED with different capabilities are being developed.

Generally, the LEDs are aligned on a circuit board to form an LED module, and the LEDs of the LED lamp having great illuminative range. However, the conventional lamp module has following disadvantages. Firstly, the height of the lamp posts are different when the street lamp being used in different illuminating situations, the LEDs of the lamp module may only illuminate single direction for the reason of limited emitting angle, then the brightness in the illuminating range are uneven when the lamp module engaged with lamp posts in different height. Secondly, the lamp module may maintain different angles relative to the ground, which may also impact the uniformity of the brightness in the illuminating range.

In order to overcome the above problems, the present Inventor proposes a novel and reasonable structure based on his delicate researches and expert experiences.

SUMMARY OF THE INVENTION

The objective of the present invention is to provide an improved LED lamp, which is able to adjust the illuminating angle.

The present invention provides an LED lamp, which includes a heat dissipating body, a rotating front cover, an LED assembly, a lens assembly, a driving unit, and a socket. The heat dissipating body has a plurality of fins for dissipating heat. The rotating front cover is rotatably disposed in the front side of the heat dissipating body, the inner wall of the rotating front ring has a screwed channel. The LED assembly is disposed in the heat dissipating body. The lens assembly has a screwed thread mating to the screwed channel and disposed in the heat dissipating body. The lens assembly can be moved via rotating the rotating front cover. The driving unit is disposed in the heat dissipating body and electrically connected with the LED assembly. The socket is disposed at one end of the driver unit.

The present invention has advantageous features as follows. The rotating front cover is rotatably disposed in the front side of the heat dissipating body, and the inner wall of the rotating front ring has a screwed channel. The lens assembly is disposed in the heat dissipating body. The lens moving ring of the lens assembly has a screwed thread mating to the screwed channel. With this arrangement, the lens assembly can be moved to adjust the illuminating angle of the LED lamp via rotating the rotating front cover.

In order to further understand the characteristics and technical contents of the present invention, a description relating thereto will be made with reference to the accompanying drawings. However, the drawings are illustrative only but not used to limit the present invention.

DETAILED DESCRIPTION OF THE PREFERRED EMBODIMENTS

Figure 1:
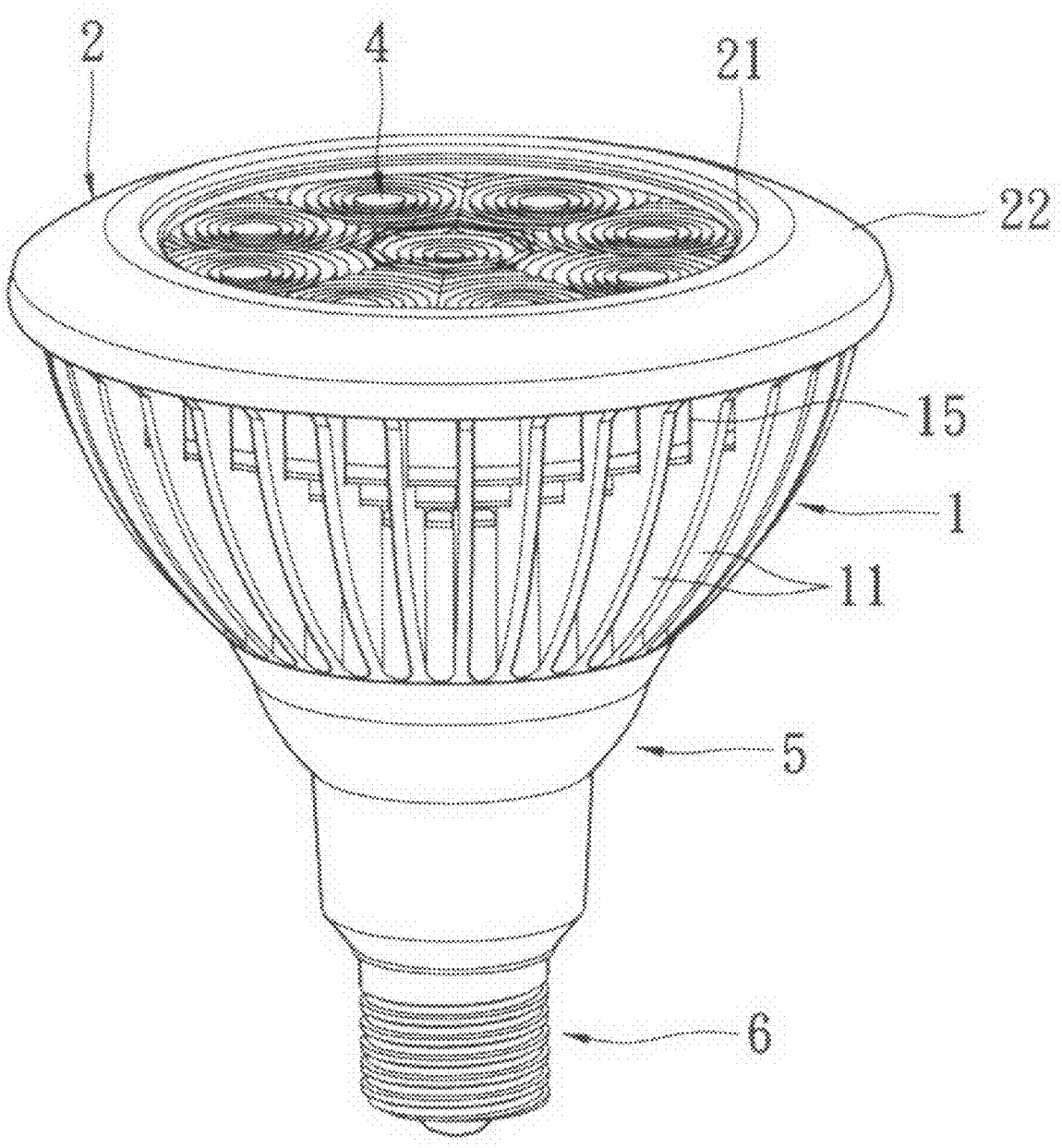
FIG. 1 is a schematic view showing the LED lamp of the present invention.
Figure 2:
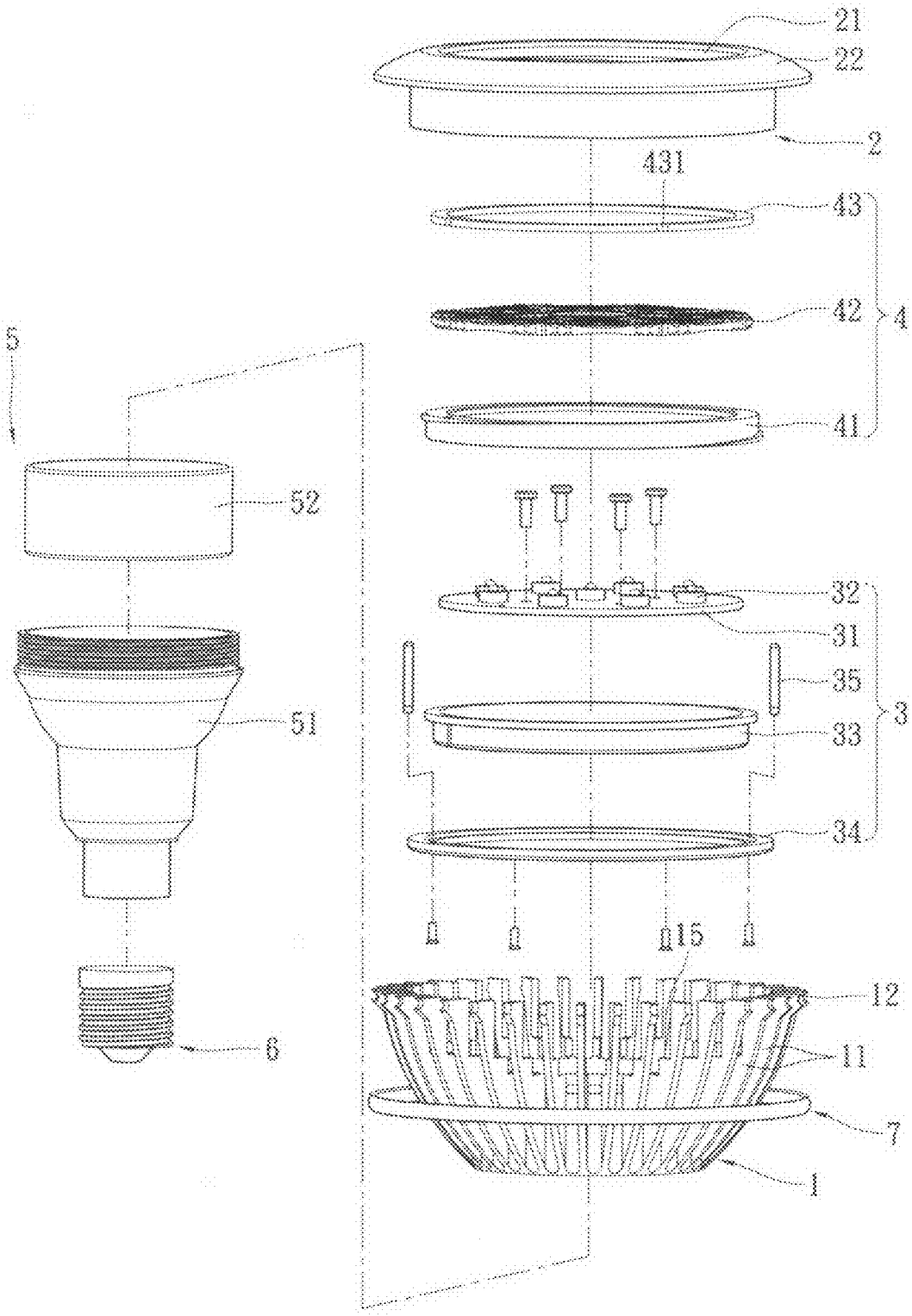
FIG. 2 is an exploded perspective view showing the LED lamp of the present invention.
Figure 3:
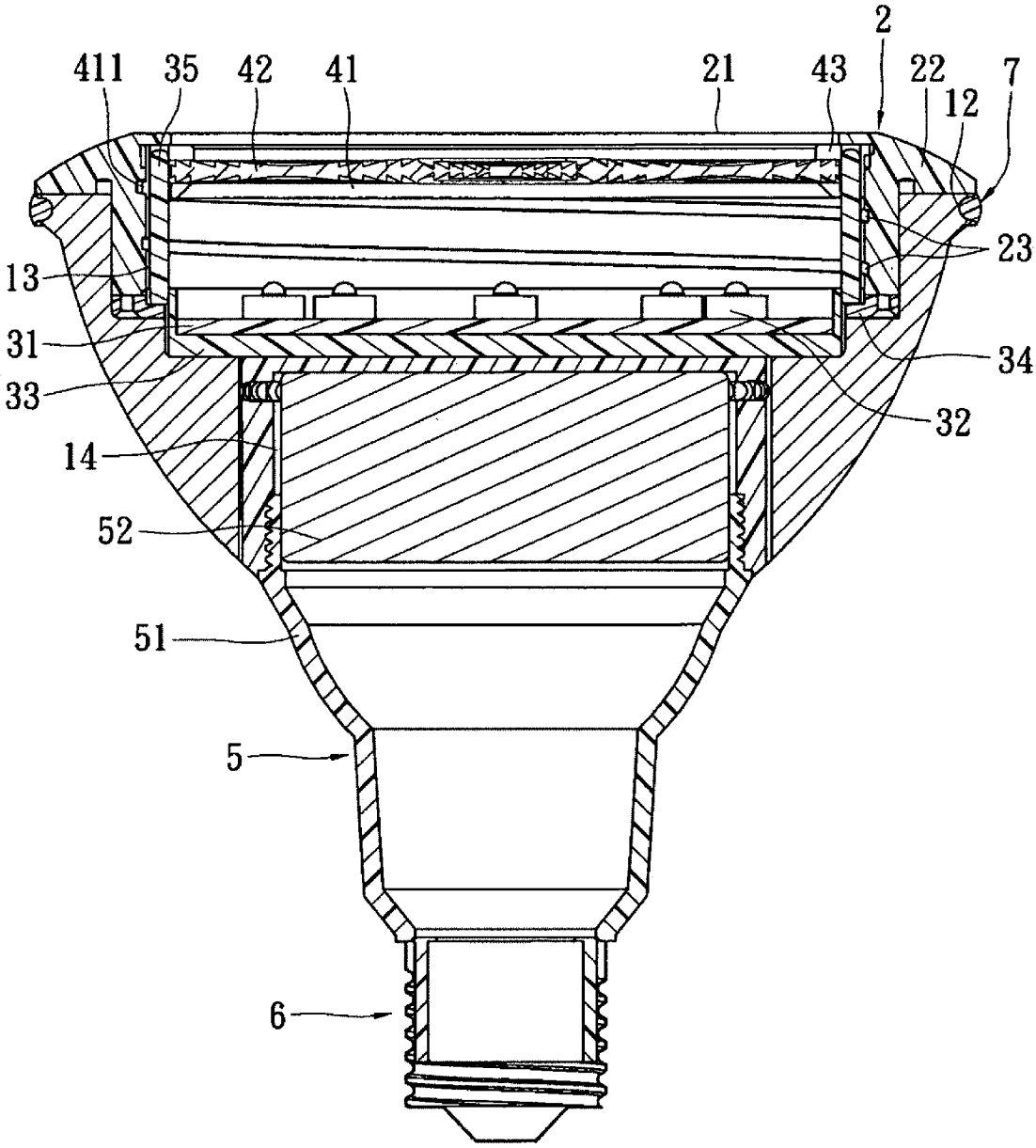
FIG. 3 is a cross section view showing the LED lamp of the present invention.

Please refer to FIGS. 1 to 5. The present invention provides an improved LED lamp, which includes a heat dissipating body 1, a rotating front cover 2, an LED assembly 3, a lens assembly 4, a driving unit 5 and a socket 6.

The heat dissipating body 1 is shaped into a circle and has high thermal conductivity. In this embodiment, the heat dissipating body 1 has a plurality of fins 11, a fixing groove 12, a first accommodating space 13, a second accommodating space 14, and a heat dissipating groove 15. The fins 11 are located around the heat dissipating body 1 and shaped into a radiate shape. The fixing groove 12 is shaped into a ring and formed around the outside of fins 11 for fixing a heat preventing element 7. The heat dissipating groove 15 is shaped into a ring and formed around the inside of the fins 11 for dissipating heat. The heat dissipating groove 15 can guide air into the heat dissipating body 1 to dissipate heat generated from the LED assembly 3.

The rotating front cover 2 is rotatably disposed in the front side of the heat dissipating body 1 and a part of the rotating front cover 2 is in the first accommodating space 13. The rotating front cover 2 has an opening 21, a flange 22, and a screwed channel 23. The opening 21 is through up to down. The flange 22 is shaped into a ring. The screwed channel 23 is formed on the inner wall of the rotating front cover 2.

The LED assembly 3 is disposed in the first accommodating space 13 of the heat dissipating body 1. The LED assembly 3 comprises a print circuit board 31, a plurality of LEDs 32, a mounting plate 33, a fixing ring 34, and two guiding bosses 35. The print circuit board 31 is mounting on the mounting plate 33. The LEDs 32 are disposed on the print circuit board 31 and electrically connected with it. The fixing ring 34 is around the mounting plate 33 for fixing. The two guiding bosses 35 are opposite located on the fixing ring 34.

The lens assembly 4 is disposed in the first accommodating space 13 of the heat dissipating body 1 and has a gap from the LED assembly 3. The lens assembly 4 comprises a lens moving ring 41, a lens 42, and a lens fixing ring 43. The lens 42 is made of light pervious material for diffusing the light radiated from the LEDs 32, and then the light radiated from the LEDs 32 has an illuminating angle. The illuminating angle would be changed according to the length of the gap. In the embodiment, the lens 42 is shaped into circular and disposed on the lens moving ring 41. The lens fixing ring 43 is disposed on the lens 42, so that the lens 42 is fixed between the lens moving ring 41 and the lens fixing ring 43. The periphery of the lens fixing ring 43 has two concave portions 431, the two guiding bosses 35 are limited in the two concave portions 431 for preventing the lens assembly form rotating. A screwed thread 411 is formed around the outer wall of the lens moving ring 41 (please refer to FIG. 3). The screwed thread 411 is mating to the screwed channel 23 of the rotating front cover 2, therefore the lens assembly 4 can be moved vertically to the print circuit board 31 to adjusted the illuminating angle via rotating the rotating front cover 2.

The driving unit 5 is disposed in the second accommodating space 14 of the heat dissipating body 1. In this embodiment, the driving unit 5 has a driver box 51 and a driver 52. One end of the driver box 51 is screwed with the inner wall of the second accommodating space 14, but it is not limited to that manner. The driver 52 is accommodated in the driver box 51 and electrically connected with the LED assembly 3 via an electric line (not shown in the FIGS.). The socket 6 is assembled with the other end of the driver box 51.

In this embodiment, the heat preventing element 7 is made of silica gel and shaped into a ring. The heat preventing element 7 is disposed in the fixing groove 12 for protecting user from getting hurt from heat and protecting users' security.

Figure 4:
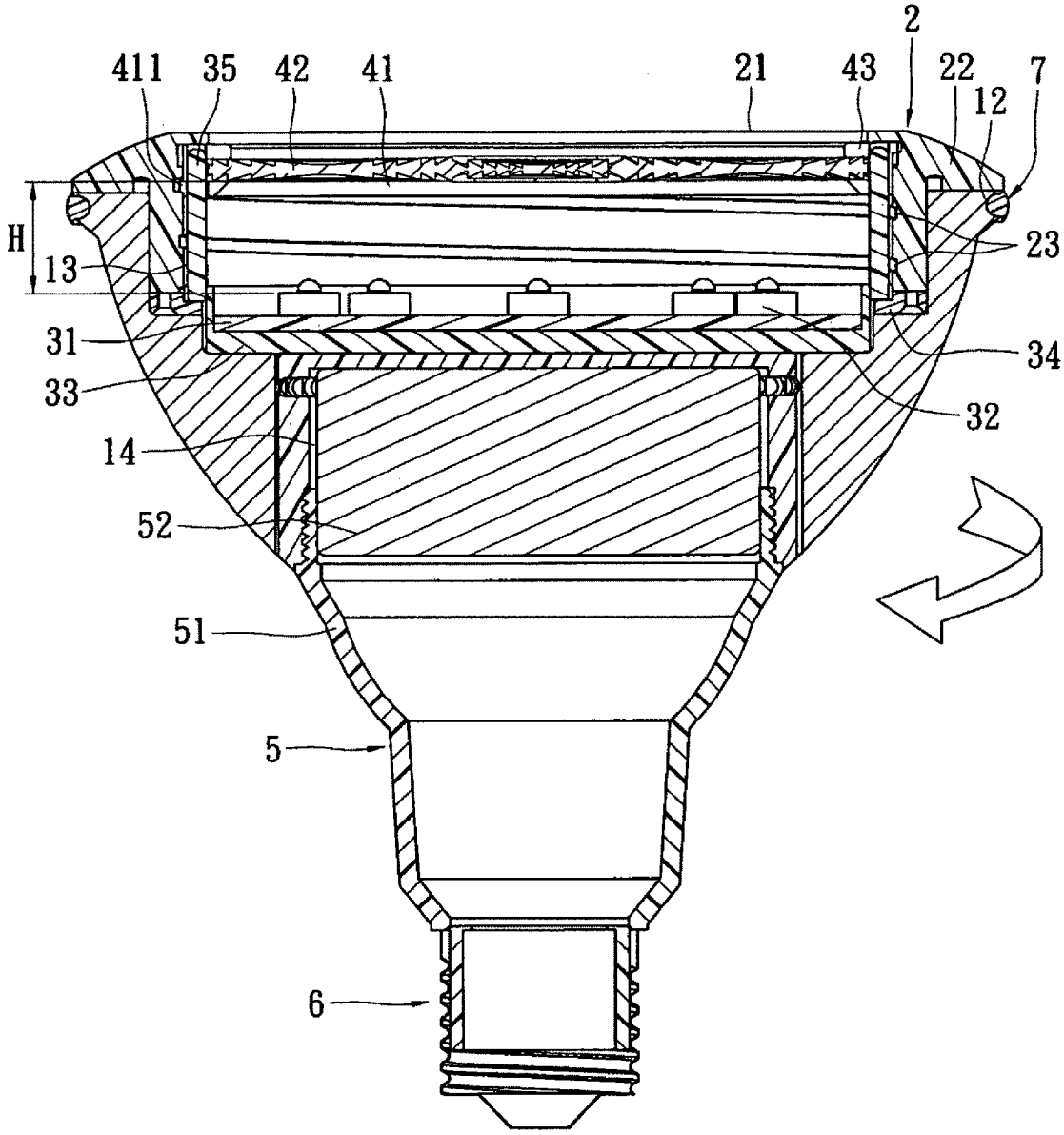
FIG. 4 is a cross section view showing one illuminating angle of the LED lamp of the present invention.
Figure 5:
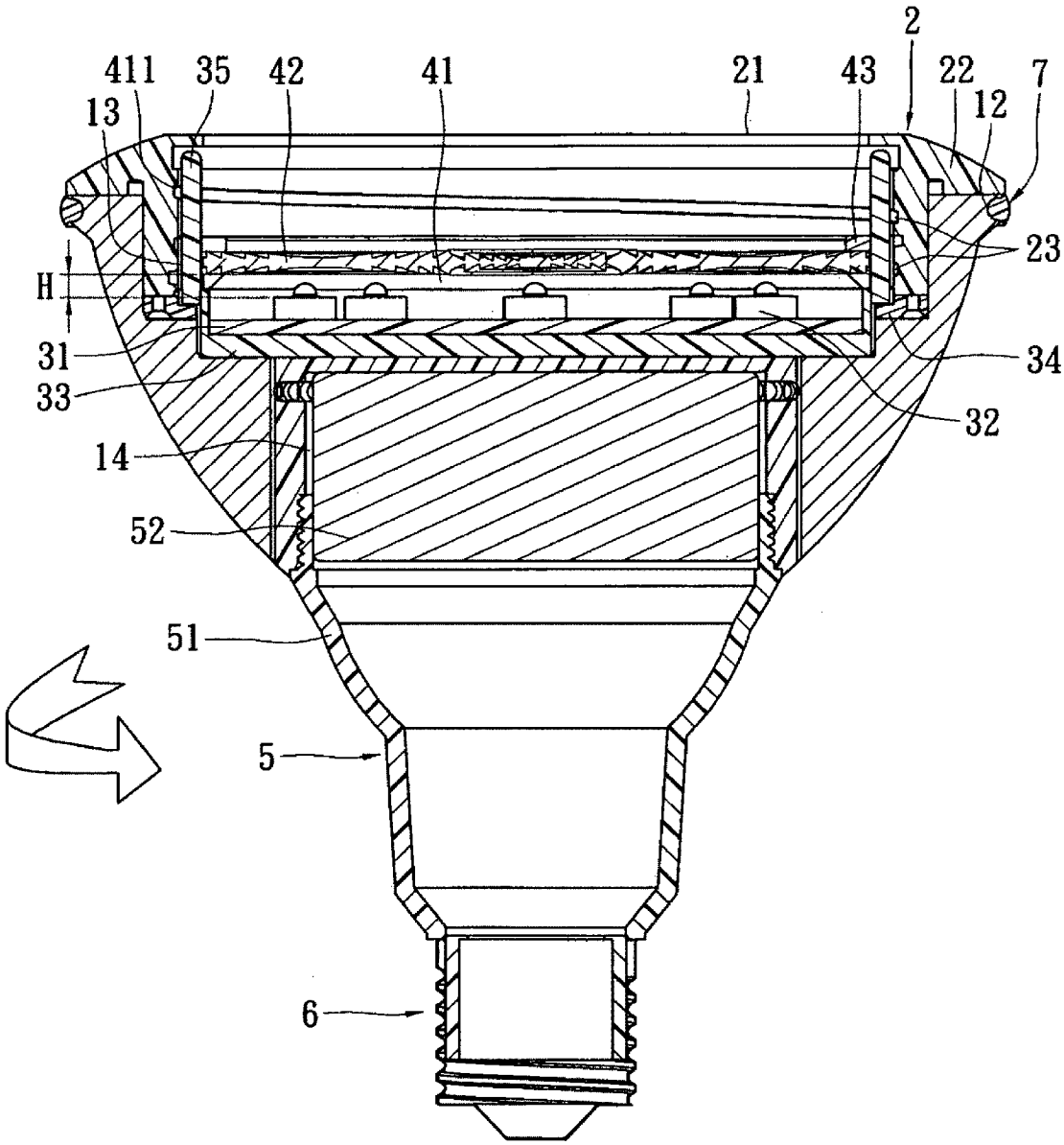
FIG. 5 is a cross section view showing another illuminating angle of the LED lamp of the present invention.

Please refer to FIG. 4 and FIG. 5, users can rotate the rotating front cover 2 by clockwise or counter-clockwise direction to make the lens assembly 4 move vertically to the print circuit board 31. While the gap H between the lens assembly 4 and the LED assembly 2 is about 15 mm, the illuminating angle of the LED lamp is about 10°. While the gap H between the lens assembly 4 and the LED assembly 2 is about 3 mm, the illuminating angle of the LED lamp is about 60°.

The present invention has advantageous features as follows. The rotating front cover 2 is rotatably disposed in the front side of the heat dissipating body 1, and the inner wall of the rotating front ring 2 has a screwed channel 23. The lens assembly 4 is disposed in the heat dissipating body 1. The lens moving ring 41 of the lens assembly 4 has a screwed thread 411 mating to the screwed channel 23. With this arrangement, the lens assembly 4 can be moved vertically to the print circuit board 31 to change the gap H between the lens assembly 4 and the LED assembly 3, and the illuminating angle of the LED lamp is adjustable via rotating the rotating front cover 2.

The above-mentioned descriptions represent merely the preferred embodiments of the present invention, without any intention to limit the scope of the present invention thereto. Various equivalent changes, alternations or modifications based on the claims of present invention are all consequently viewed as being embraced by the scope of the present invention.

What is claimed is:

1. An LED lamp with adjustable illuminating angle, comprising:

a heat dissipating body having a plurality of fins, the fins being disposed around the heat dissipating body;

a rotating front cover being rotatably disposed in the front side of the heat dissipating body, the inner wall of the rotating front cover has a screwed channel;

an LED assembly being disposed in the heat dissipating body, the LED assembly comprises a printed circuit board, a plurality of LEDs, a mounting plate, a fixing ring, and two guiding bosses, wherein the printed circuit board is mounted on the mounting plate, wherein the plurality of LEDs is disposed on the printed circuit board, wherein the two guiding bosses are disposed on the fixing ring, wherein the fixing ring is for fixing the mounting plate;

an lens assembly having a screwed thread mating to the screwed channel and disposed in the heat dissipating body, the lens assembly being moved via rotating the rotating front cover;

a driver unit being disposed in the heat dissipating body and electrically connected with the LED assembly; and a socket being disposed at one end of the driver unit.

2. The LED lamp with adjustable illuminating angle according to claim 1, wherein the heat dissipating body has a first accommodating space and a second accommodating space, the front ring, the LED assembly, the lens assembly are disposed in the first accommodating space, the driving unit is disposed in the second accommodating space.

3. The LED lamp with adjustable illuminating angle according to claim 1, wherein the heat dissipating body has a fixing groove, the fixing groove is around the outside of fins, and a heat preventing element being disposed in the fixing groove for protecting user from getting hurt.

4. The LED lamp with adjustable illuminating angle according to claim 1, wherein the heat dissipating body has a heat dissipating groove, the heat dissipating groove is around the inside of fins for dissipating heat.

5. The LED lamp with adjustable illuminating angle according to claim 1, wherein the lens assembly comprises a lens moving ring, a lens, and a lens fixing ring the screw thread is around the wall of the lens moving ring, the lens is fixed between the lens fixing ring and the lens moving ring.

6. The LED lamp with adjustable illuminating angle according to claim 1, wherein the lens fixing ring has two concave portions, the two guiding bosses are respectively limited in the two concave portions for preventing the lens assembly from rotating.

7. The LED lamp with adjustable illuminating angle according to claim 1, wherein the driving unit comprises a driver box and a driver, the driver is accommodated in the driver box and electrically connected with the LED assembly.

8. The LED lamp with adjustable illuminating angle according to claim 1, wherein the fins are shaped into a radiate shape.

* * * * *